US007087003B1

(12) United States Patent
Katterjohn

(10) Patent No.: US 7,087,003 B1
(45) Date of Patent: Aug. 8, 2006

(54) EXERCISE SYSTEM AND METHOD

(76) Inventor: Carol Katterjohn, 7124 Purdy St., Indianapolis, IN (US) 46268

( * ) Notice: Subject to any disclaimer, the term of this patent is extended or adjusted under 35 U.S.C. 154(b) by 0 days.

(21) Appl. No.: 11/053,637

(22) Filed: Feb. 9, 2005

(51) Int. Cl.
*A63B 21/02* (2006.01)

(52) U.S. Cl. ..... 482/124; 482/126; 74/594.6

(58) Field of Classification Search ..... 482/79, 482/129, 124–125, 121, 148; 74/594.6
See application file for complete search history.

(56) References Cited

U.S. PATENT DOCUMENTS 602,692 A * 4/1898 Basch ..... 74/594.6
2,760,774 A * 8/1956 Perez ..... 482/79
4,728,103 A * 3/1988 Fulton ..... 482/125
4,856,211 A * 8/1989 Phillips ..... 36/131
4,870,873 A * 10/1989 Tackles ..... 74/594.6
5,062,642 A * 11/1991 Berry et al. ..... 473/277
D323,478 S * 1/1992 Ueda ..... D12/125
5,372,565 A * 12/1994 Burdenko ..... 482/124
5,545,113 A * 8/1996 Bobich ..... 482/125
5,624,360 A * 4/1997 Wilkins ..... 482/129
5,688,213 A * 11/1997 Recker ..... 482/125
5,713,142 A * 2/1998 Ahmed Fahmey El-Circy ..... 36/132
5,716,307 A * 2/1998 Vadher ..... 482/125
5,720,042 A * 2/1998 Wilkinson ..... 2/69
5,737,977 A * 4/1998 Surdi et al. ..... 74/594.6
5,782,727 A * 7/1998 Pierce ..... 482/129
5,836,857 A * 11/1998 Jennings ..... 482/92
5,941,802 A * 8/1999 Kiser ..... 482/92
6,059,698 A * 5/2000 Mazor ..... 482/79
6,312,361 B1 * 11/2001 Hayes ..... 482/51
6,322,483 B1 * 11/2001 Rotella ..... 482/129
6,361,516 B1 * 3/2002 Hamel ..... 602/27
6,361,517 B1 * 3/2002 Slinger ..... 602/28
6,368,258 B1 * 4/2002 Emlaw ..... 482/124
6,390,957 B1 * 5/2002 Knight ..... 482/79
6,425,844 B1 * 7/2002 Azar ..... 482/79
6,540,651 B1 * 4/2003 Aberton et al. ..... 482/124
6,837,834 B1 * 1/2005 Basting ..... 482/124
6,854,200 B1 * 2/2005 Hipp et al. ..... 36/96
2002/0068667 A1 * 6/2002 Strachan ..... 482/124
2003/0092545 A1 * 5/2003 Koscielny et al. ..... 482/124
2003/0130098 A1 * 7/2003 Marco ..... 482/124
2003/0195092 A1 * 10/2003 Basting ..... 482/124
2004/0009858 A1 * 1/2004 Tamaribuchi ..... 482/139
2004/0185990 A1 * 9/2004 Orescan et al. ..... 482/126
2004/0192520 A1 * 9/2004 Wilcocks ..... 482/124
2004/0204302 A1 * 10/2004 Flynn ..... 482/124
2004/0235624 A1 * 11/2004 Bruce ..... 482/125
2005/0043150 A1 * 2/2005 Nitta et al. ..... 482/79
2005/0096201 A1 * 5/2005 Thelen et al. ..... 482/124
2005/0192168 A1 * 9/2005 Wilcocks ..... 482/124

* cited by examiner

*Primary Examiner*—Lori Amerson
(74) *Attorney, Agent, or Firm*—Daniel J. O'Connor

(57) ABSTRACT

An exercise system and method of use to achieve numerous workout possibilities without requiring attachment of the device to a fixed object such as a door or wall. The system includes a specially designed shoe clip for attachment to the front end of an exercise or tennis shoe. A strapping element, for use in conjunction with the shoe clip, is also specially designed for the overall system. The system and method are applicable for a wide variety of workout routines. The system includes attachment devices so that stretchable resistance bands or stretchable tubing material can be easily changed to vary the workout difficulty as desired.

1 Claim, 6 Drawing Sheets

EXERCISE SYSTEM AND METHOD

BACKGROUND AND OBJECTS OF THE INVENTION

The present invention is generally related to the exercise and physical fitness arts and, in particular, to a novel system and method for exercising many parts of the body.

U.S. Pat. No. 6,540,651 issued to Aberton shows a system which uses an anchor point and a stocking device worn on a lower limb of a user.

U.S. Pat. No. 6,508,749 issued to Broadwater shows a portable exercise device with a handle grip for use in golf practice training.

U.S. Pat. Nos. 6,322,483 and 6,059,698 are examples of door mounted exercise devices.

U.S. Pat. No. 5,624,360 issued to Wilkins in 1997 teaches the use of an exercise system and method which incorporates a foot holster for use in stretching exercises. The methods of use suggested by Wilkins typically require a door or other type of fixed attaching point.

Accordingly, it is an object of the present invention to demonstrate an exercise system which utilizes specially designed shoe clips and strap elements so that a separate fixed point is not required in use of the device.

It is also an object of the invention to set forth an exercise system which is highly effective and which is easily transportable by the user.

It is a further object of the invention to show an exercise system which is fabricated of economical plastic/rubber, cloth and equivalent compounds.

It is a still further object to demonstrate a stretching band type of exercise method which does not require the bands to be tied about the hands or or feet for effective use.

It is also an object to describe an exercise system which may be economically mass-produced for widespread commercial appeal in the art.

SUMMARY OF THE INVENTION

Specially designed shoe clips are shown which include:

a) an upper generally flat section which includes aperture means for receipt of a strap element,
b) a middle section which includes two generally curved legs which extend from the upper section,
c) a lower generally flat section which also includes aperture means for receipt of a strap element.

The strap elements each include side-mounted D-rings to provide easy attachment of stretching band elements.

The strap elements each include hook and loop fastener sections and a portion which extends around the back of the user's shoe for added support and a more efficient exercise workout.

A wide variety of exercises may be performed in use of the economically mass-produced system and method of use.

BRIEF DESCRIPTION OF THE DRAWING FIGURES

FULL DESCRIPTION OF THE PREFERRED EMBODIMENTS

Figure 2:
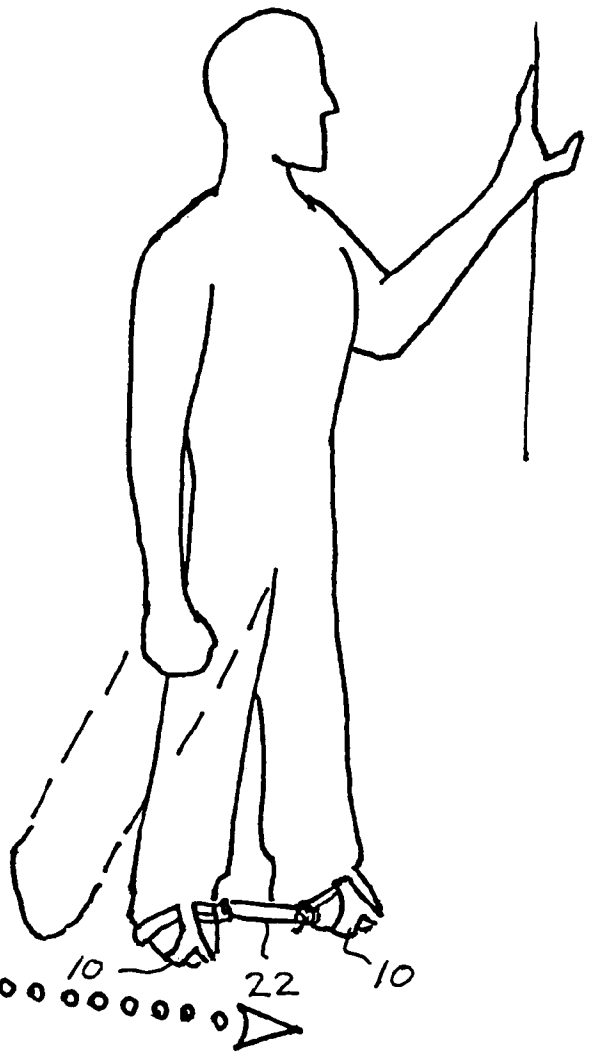
FIGS. 1 through 5 show various exercise methods which may be practiced utilizing the system described herein.

Referring to the drawing FIGS. 1–5, some of the many methods of use of the invention are shown.

Figure 1:
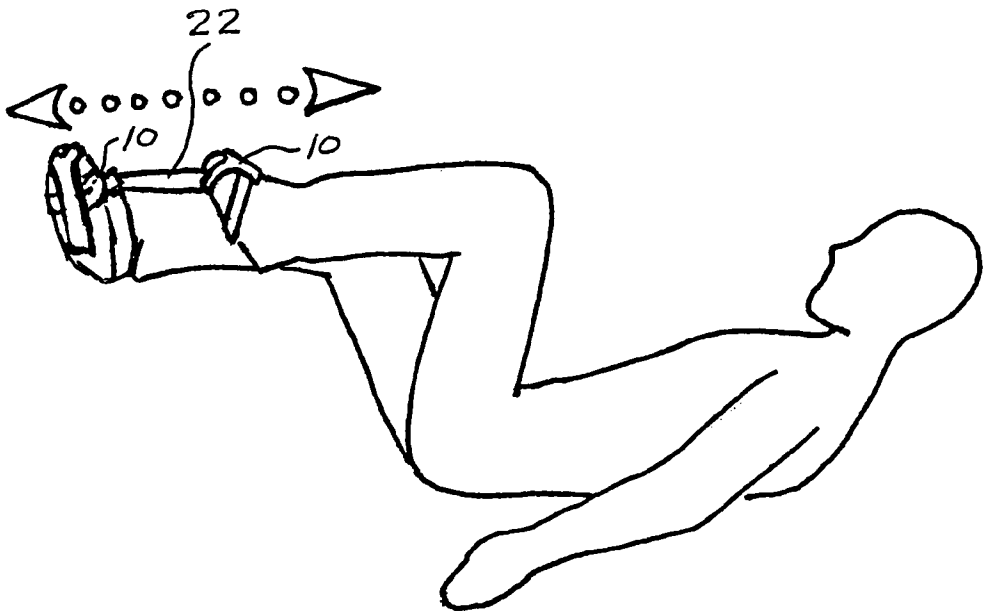

As illustrated in FIG. 1, shoe clips 10 are placed on each shoe and a resistance band 22 extends between the shoe clips. Such a configuration can be utilized in the supine position shown in FIG. 1 or the standing position of FIG. 2.

Figure 3:
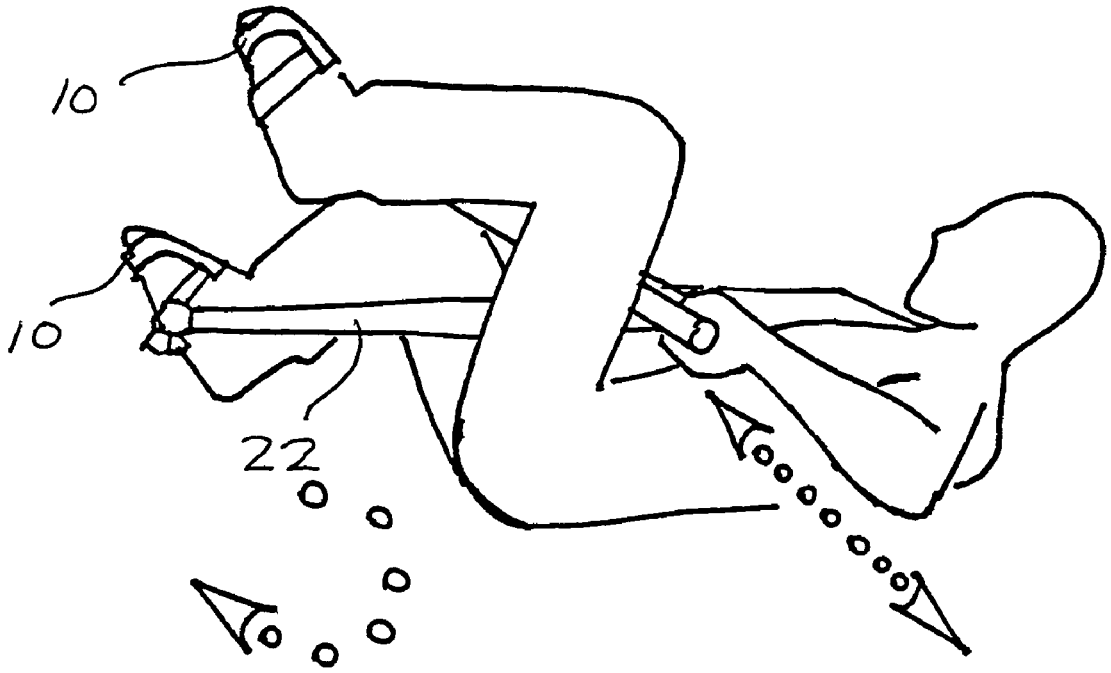
Figure 5:
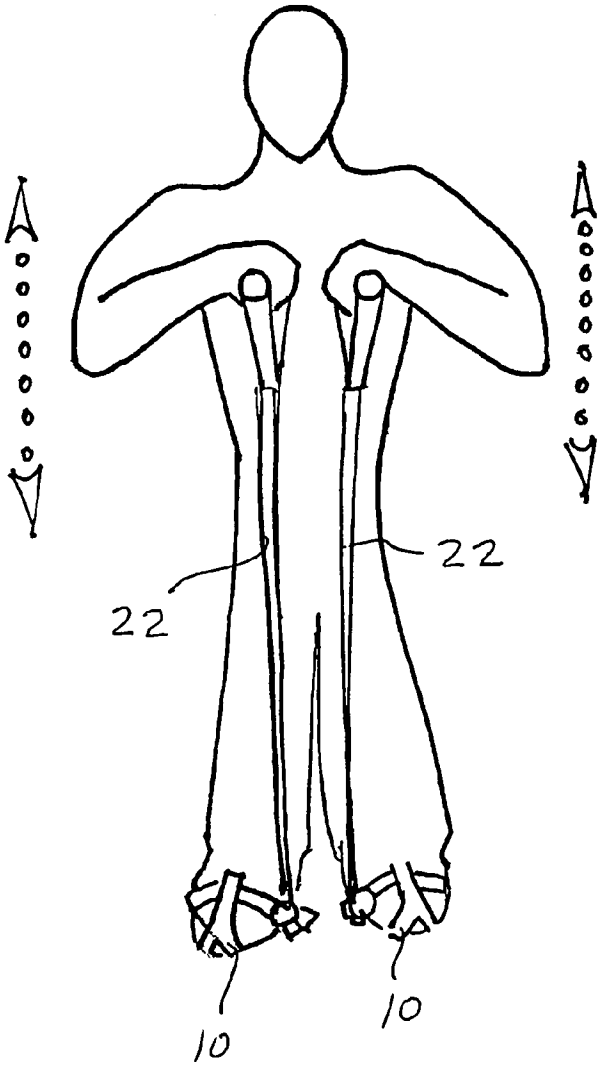
Figure 4:
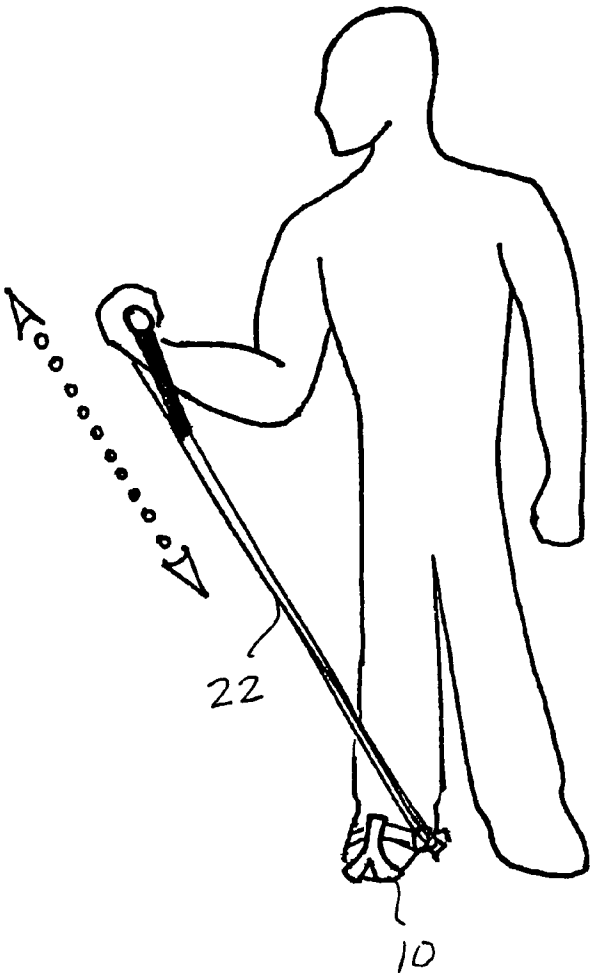

FIGS. 3 and 4 show the use of a handle element while FIG. 5 shows the use of plural handle units attached to respective shoe clips.

The method steps used in practice of the invention are broadly described as follows:

a) placement of shoe clips 10 on the shoes of a person beginning a workout,
b) attaching a resistance band 22 to extend between said shoe clips,
c) exercising from a standing or a supine position as indicated in FIGS. 1 and 2.

In an equivalent usage, bands or tubing can be placed on the outsides of the shoes to effect an added variety of exercise and stretching routines.

Figure 6:
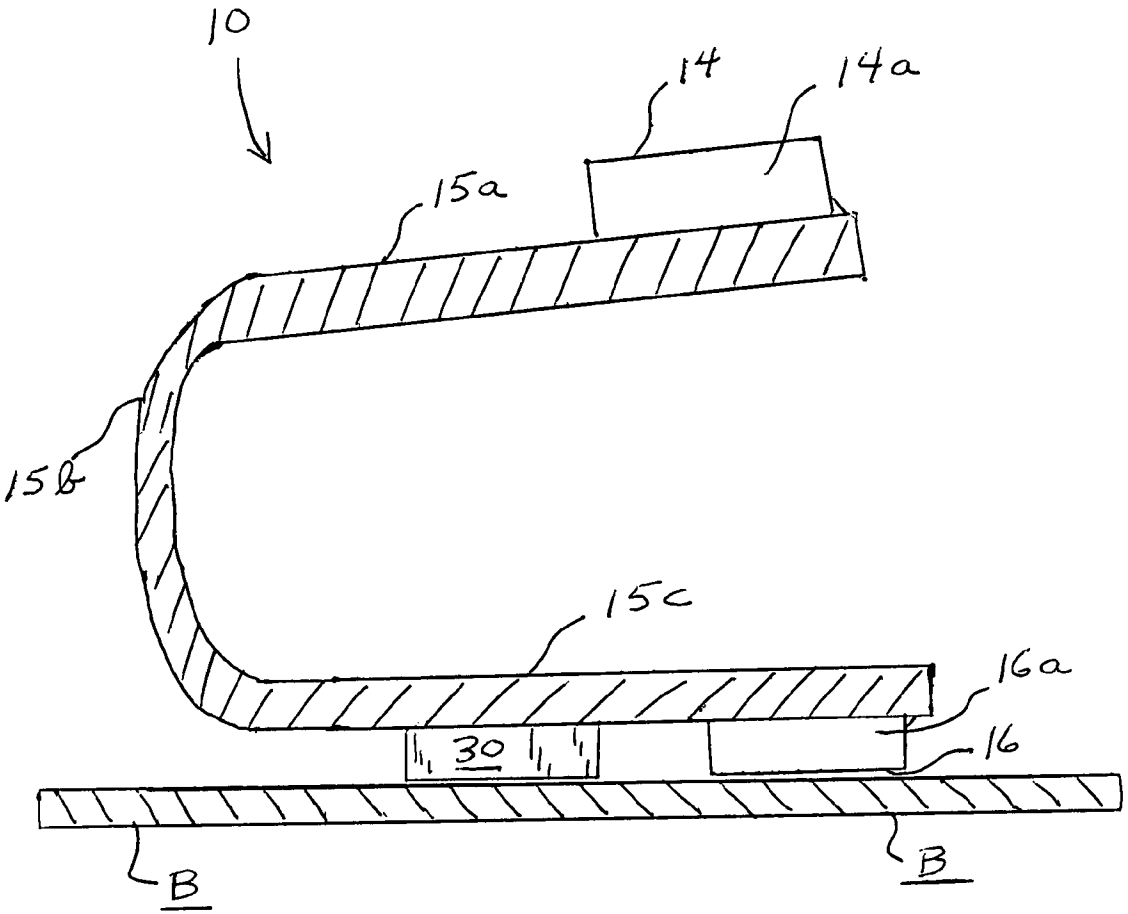
FIG. 6 is a side schematic view of the shoe clip of the present invention. The forward end of a tennis or exercising shoe is placed within said shoe clip.

Referring to the drawing FIG. 6 which shows a side schematic view of a shoe clip structure, a shoe clip 10 is shown as resting on a floor or base B.

As shown, each shoe clip of the invention has an upper area 15*a* in which is formed an aperture or loop 14*a* which has a top portion or wall 14.

The upper area 15*a* extends into a central curved area 15*b* which is shaped so as to receive the toe portion for various sizes of exercise shoes. Central area 15*b* may be comprised of one or more elements as will be further shown.

Curved central area 15*b* extends into a lower straight section 15*c*. Lower section 15*c* has an aperture or loop 16*a* formed formed at an end thereof by means of a lower wall 16.

Apertures or loops 14*a* and 16*a* are provided for the receipt of strapping material to be further described.

As further shown in FIG. 6, the lower section 15*c* of shoe clip 10 includes ridge means 30 which provides for traction and stability. The ridge means 30 is further shown herein and is approximately of a depth to level out the bottom of the overall shoe clip 10.

Figure 7:
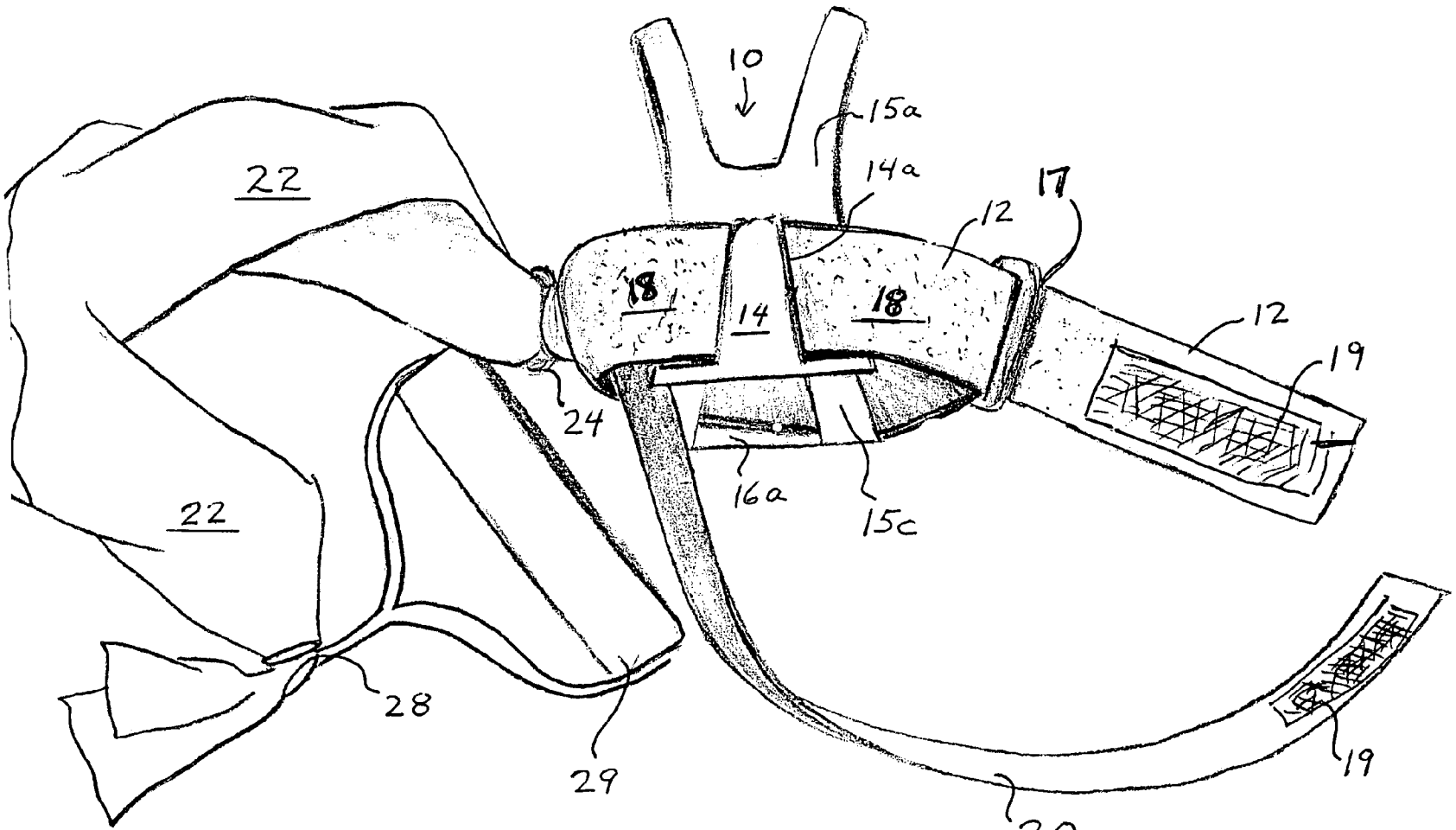
FIG. 7 is a top view of the shoe clip with the associated strapping elements mounted thereon. A resistance band and handle are also shown in FIG. 7.

Referring to the top schematic view of FIG. 7, the shoe clip 10 is shown as having a top section 15*a* with aperture 14*a* formed therein. Such aperture 14*a* receives strapping 12 which has hook and eye closures thereon as indicated at numerals 18 and 19.

Also visible in FIG. 7 is the lower section 15*c* of the shoe clip having the lower aperture 16*a* formed therein.

Numeral 17 indicates a strap retaining element which is placed on one end of strap material 12.

An elastic strap 20 extending from the main strap 12 is of sufficient length to extend around the back of a shoe for stability.

As further indicated in FIG. 7, numeral 24 shows an attachment device for attaching elastic bands or tubing to the exercise system. The device 24 may comprise, for example, a D-ring type connector which is attached to the strapping material at a point where it is positioned at the inside of an exercise shoe.

FIG. 7 further shows a resistance band 22 which is connected to a handle element 29 by means of attachment mechanism 28. Attaching device 28 may comprise, for example, a D-ring type connector which is attached to the strapping of handle 29.

The connector devices shown at 24 and 28 allow the resistance bands 22 to be easily changed depending upon the type of workout desired.

For example, a person doing a rehabilitative type of exercise on one side of the body could choose a resistance band which provides lesser resistance and is easier to operate. The resistance band shown in FIG. 7 may also be an elastic type of tubing.

Figure 8:
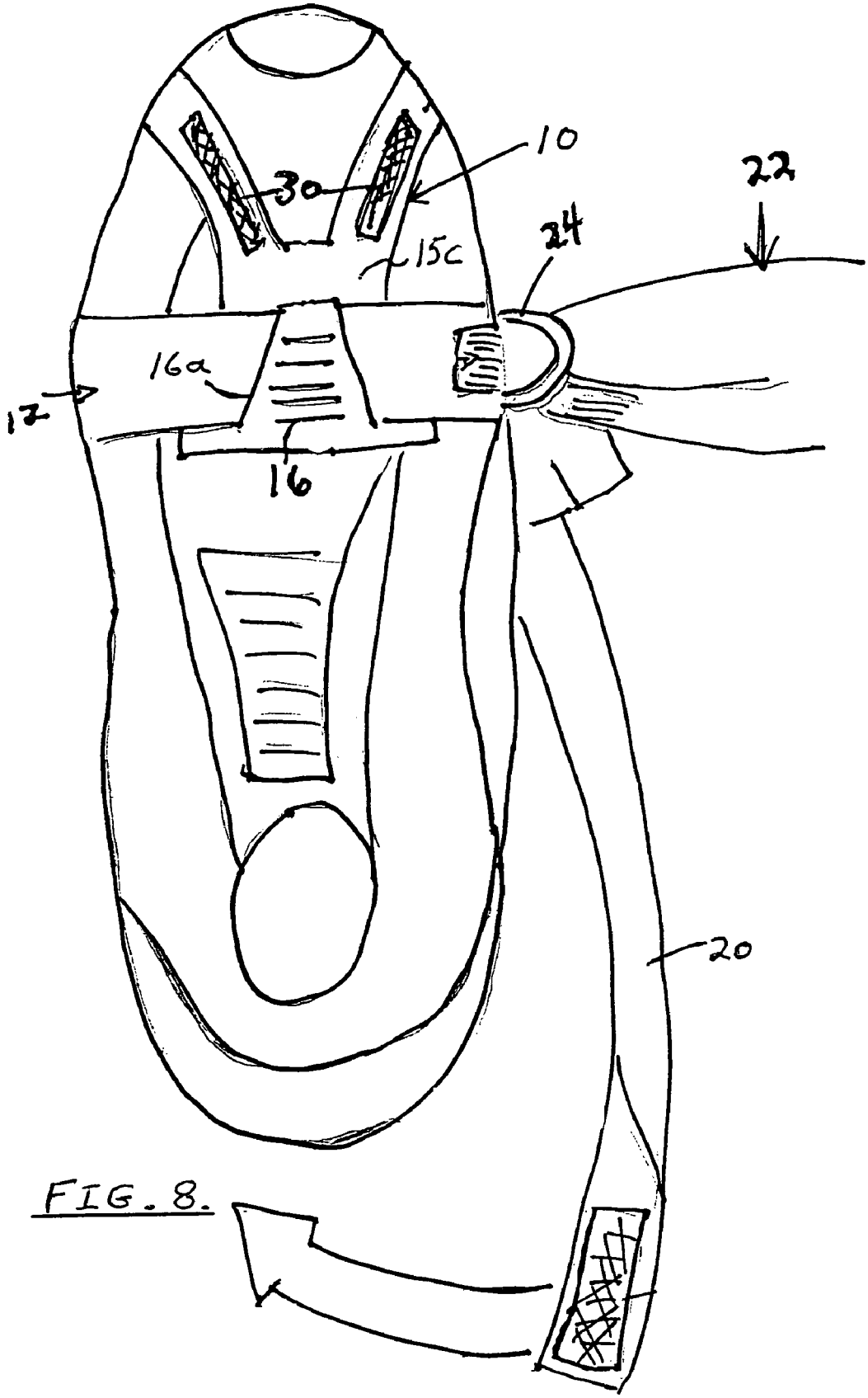
FIG. 8 is a bottom view of the shoe clip with a shoe inserted therein. The ridges for traction and stability as well as the D-ring and elastic strap for placement around the back of the shoe are also shown.

Referring to the bottom view of FIG. 8, a lower portion 15*c* of the shoe clip 10 is shown as having an aperture 16*a* formed by wall 16 for receipt of strapping material 12.

Ridges 30 are also shown in FIG. 8. In this embodiment, plural ridges are shown, i.e. one ridge for each leg. It is noted that if a different curved leg configuration were used, e.g. a single wider leg instead of the two curved legs shown, the ridges 30 may be configured differently.

FIG. 8 also shows the D-ring type of attachment mechanism 24 to which is attached a resistance band 22.

The elastic strap 20 which extends around the back of the shoe is also shown.

The shoe clip 10 and combined strapping material 12 are configured and connected to the exercise shoe so that the main pressure point is at or near the ball of a user's foot. Such configuration provides that the person exercising produces the maximum force output.

While particular systems and methods of use have been shown and illustrated, it is intended in this specification to include all equivalent systems and equivalent methods which would reasonably occur to those of skill in the art.

Under the doctrine of equivalents as described in federal case law and statutes, it is considered an equivalent usage when a resistance band is placed on the outside of a shoe to enable various alternative exercise and stretching routines. Other equivalent uses include tubing in place of a stretchable resistance band. Stretching is deemed an equivalent to the term exercise as used in the specification.

The invention is further defined by the claims appended hereto.

I claim:

1. A shoe clip and strap element apparatus for use in an exercise system supported on a floor or base, said apparatus comprising:

A shoe, a strap element, a one-piece plastic shoe clip having an upper flat area including an aperture for receiving said strap, said upper flat area of said shoe clip extending into a central area having at least one generally curved leg for receiving a toe portion of said shoe, said central middle area of said shoe clip extending into a lower generally flat straight section having an aperture formed at an end by support means, said strap element extending through each of said apertures in said upper area and said lower section of said shoe clip, said lower section of said shoe clip further having ridge means for providing traction and stability to a user while exercising, a strap retaining element positioned on one end of said strap element for securing said strap element to said shoe, an elastic strap connected to one side of said strap element and extending rearwardly around a back portion of said shoe to an opposite side of said strap element for stabilizing said shoe within said strap element, an attachment device mounted on a side of said strap element for attaching at least one resistance band, said resistance bands having a first end connected to said attachment device and a second end connected to a handle element, whereby the shoe clip and strap element are configured and connected to an exercise shoe, the resistance bands are attached to the attachment device and a user begins an exercise routine such that when exercising, the main pressure point is at or near the ball of a user's foot in order to provide a maximum force output.

* * * * *